US008435047B2

(12) United States Patent
Patel et al.

(10) Patent No.: US 8,435,047 B2
(45) Date of Patent: May 7, 2013

(54) MODULAR CONNECTORS WITH EASY-CONNECT CAPABILITY

(75) Inventors: Arvind Patel, Naperville, IL (US); Bratislav Kostic, Elmhurst, IL (US); Kenneth M. Stiles, Rochester, MN (US); Ron Fox, Hillsborough, NC (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/999,068

(22) Filed: Dec. 4, 2007

(65) Prior Publication Data

US 2009/0142970 A1 Jun. 4, 2009

(51) Int. Cl.
*H01R 12/00* (2006.01)

(52) U.S. Cl.
USPC ..... 439/76.1; 439/532; 439/660

(58) Field of Classification Search ..... 439/76.1, 439/532, 660
See application file for complete search history.

(56) References Cited

U.S. PATENT DOCUMENTS

| | | | | | |
|---|---|---|---|---|---|
| 4,790,763 | A | | 12/1988 | Weber et al. | |
| 4,915,641 | A | | 4/1990 | Miskin et al. | |
| 4,984,998 | A | * | 1/1991 | Duncan et al. | 439/352 |
| 5,575,690 | A | * | 11/1996 | Eaton | 439/717 |
| 5,584,728 | A | | 12/1996 | Cheng | |
| 5,921,796 | A | * | 7/1999 | Morlion et al. | 439/247 |
| 6,024,607 | A | | 2/2000 | Wahl | |
| 6,095,825 | A | | 8/2000 | Liao | |
| 6,155,872 | A | * | 12/2000 | Wu | 439/541.5 |
| 6,171,154 | B1 | | 1/2001 | Juntwait et al. | |
| 6,319,075 | B1 | * | 11/2001 | Clark et al. | 439/825 |
| 6,358,067 | B1 | * | 3/2002 | Takase et al. | 439/79 |
| 6,419,515 | B1 | * | 7/2002 | Okayasu | 439/358 |
| 6,475,031 | B1 | * | 11/2002 | Wu | 439/570 |
| 6,780,018 | B1 | | 8/2004 | Shipe | |
| 6,848,950 | B2 | * | 2/2005 | Allison et al. | 439/682 |
| 6,890,221 | B2 | * | 5/2005 | Wagner | 439/855 |
| 6,896,556 | B1 | | 5/2005 | Wu | |
| 6,927,974 | B2 | | 8/2005 | Robillard et al. | |
| 7,065,871 | B2 | * | 6/2006 | Minich et al. | 29/882 |
| 7,118,390 | B2 | * | 10/2006 | Kita | 439/76.2 |
| 7,137,848 | B1 | | 11/2006 | Trout et al. | |
| 7,147,519 | B2 | | 12/2006 | Reichle | |
| 7,168,963 | B2 | | 1/2007 | Minich et al. | |
| 7,488,222 | B2 | * | 2/2009 | Clark et al. | 439/825 |
| 7,632,110 | B2 | * | 12/2009 | Kanou et al. | 439/76.2 |
| 7,726,982 | B2 | * | 6/2010 | Ngo | 439/79 |
| 2006/0084294 | A1 | * | 4/2006 | Kita | 439/76.2 |

* cited by examiner

*Primary Examiner* — Truc Nguyen
(74) *Attorney, Agent, or Firm* — Stephen L. Sheldon

(57) ABSTRACT

Modular connectors are provided that have a modular receptacle connector assembly matable with a modular plug connector assembly for connecting AC or DC power connectors and electrical signals including board-to-board and wire-to-board connection. Provided is a "pass through" modular component to facilitate connection and disconnection of only the power supply for service without disconnecting the entire system. The wire connector also may load to the main housing thus obviating the need for a panel mount. Also provided is a one-unit modular connector system with either a coplanar or a right-angle design. Furthermore, multiple AC and/or DC power supplies can be provided that utilize minimum board space.

9 Claims, 11 Drawing Sheets

MODULAR CONNECTORS WITH EASY-CONNECT CAPABILITY

BACKGROUND OF THE INVENTION

This present invention generally pertains to modular electrical connector systems that comprise a receptacle connector assembly and a plug connector assembly for connecting AC and DC power and electrical signals by overall arrangements that include wire-to-board, board-to-board, coplanar and right angle connections. The modular connectors, advantageously exhibiting minimum height and width dimensions, can transmit multiple power supplies, while having the capability to easily connect and disconnect the connector assembly from the power input module.

DESCRIPTION OF BACKGROUND ART

Modular connectors have desired features such as flexibility that allow easy assembly of connector systems with many configurations at low manufacturing costs. While modular systems are attractive there are many aspects in which improvement is sought. For example, there is a desire to plug and unplug the power source without unplugging the entire connector, to employ the same connector for both board-to-board and wire-to-board contacts, to have secure connections that avoid a separate panel mount, to provide interlocking features that ensure proper alignment with increased interlock strength and to conserve space on the bases that the modular system connects. There is also a desire to provide modular connector assemblies that can transmit multiple AC and DC power supplies. There is an overall need to improve modular connectors and overcome the deficiencies of the prior art.

Prior art approaches include U.S. Pat. No. 4,790,763. This patent pertains to a modular connector assembly that includes distributing different levels of power between printed circuit boards (PCBs) such as mother and daughter PCBs. The modules are of a mixed type with a variety of power carrying contacts, polarizing modules and signal modules. The modules disclosed are interlinked with specific module side structures that require a rotary action of two side-by-side modules for the modules to engage and interlink. A polarizing key lock feature is provided by a snap ring including a slot to permit engagement and disengagement by a tool such as a screwdriver. U.S. Pat. No. 5,575,690 describes a rigid hybrid electrical connector for printed circuit boards that can be assembled from a number of interlocking power connector modules, signal connector modules, spacer modules and mounting flange modules. While only female type modules are produced the female modules can be converted to a male module with an adapter. The patent includes a modular connector system that has either a female to male adapter in a socket or a spacer.

U.S. Pat. No. 5,584,728 relates to an elongated modular connector comprising a plurality of connector modules each having an insulative housing and a plurality of contacts therein. Each module is a card edge connector. Every two adjacent connector modules are connected to each other in an end-to-end relationship. An external fastening means latchably aligns two adjacent modules together so the connector can lengthwise extend itself by adding modules to increase signal and power transmission. The patent describes a central slot extending through the whole housing in the lengthwise direction for reception of a board edge device or a board.

Other prior art includes the following. U.S. Pat. No. 6,024,607 relates to a female combination connector for connecting a computer storage drive to a printed circuit board. It includes a plurality of female connector elements affixed to a base. The plurality of female connectors correspond to a plurality of male connectors on a computer storage drive. The female combination connector also comprises a printed circuit board connector. The printed circuit board connectors includes a plurality of conductors, each of which is supported by the base, and each of which is electrically coupled to one of the plurality of female connector elements. The connector elements may be affixed to the base in a number of ways. The connector elements and the base may be integrally molded as one unit or may be individually manufactured and then bonded together. U.S. Pat. No. 7,137,848 pertains to a connector family that comprises a central housing having a connector mating face and a board-mounting interface. An outer shell is shaped to fit over the central housing. The outer shell partially encloses the board mounting interface and exposes the connector mating interface of the central housing. The outer shell has a mating interface that is configured to be joined by a cable. Contacts are held in the central housing. The contacts, central housing and outer shell are used in different configurations depending on the application.

With the present approach, it has been determined that various characteristics of prior art such as these patents may have shortcomings such as these and undesirable attributes, results or effects. The present approach recognizes and addresses matters such as these to provide enhancements not heretofore available. Overall, the present approach more fully meets the need to plug and unplug the power source without unplugging the entire connector, to have the same connector for both board-to-board and wire-to-board contacts, to have secure connection that avoids a separate panel mount, to provide interlocking features that ensure proper alignment with increased interlock strength, to conserve space on the base to which the modular system connects and to have a one unit modular connector system with either a coplanar or a right angle design. Furthermore, the present invention provides modular connector systems that transmit several AC and/or DC power supplies.

SUMMARY OF THE INVENTION

An aspect or embodiment of the invention pertains to an improved modular connector system that comprises a receptacle connector assembly and a plug connector assembly having board-to-board connection of power and electrical signal modules. The invention includes a wire-to-board option with "pass-through" feature in order to easily connect and disconnect only the power supply in order to facilitate carrying out of needed actions. For example, the system can be serviced without disconnecting the entire system. The wire connector may load to a main housing thus obviating the need for a panel mount.

In accordance with another aspect or embodiment, multiple receptacle contacts, five for example, mating with plug contacts transmit AC or DC power supplies. The AC voltages can be between about 90 and about 600 volts and typically between about 100 and about 250 volts. Each AC power supply can have a current of between about 10 and about 50 amps and typically between about 20 and about 40 amps. Each DC power supply can be between about 1 and about 70 volts and typically about between about 5 and about 18 volts. In this embodiment, power wires connect with receptacle contacts in a power supply module. One wire is a ground wire and the others wires are hot and neutral wires. The hot wires and the neutral wires are between about 8 and about 14 AWG wire and typically between about 10 and about 12 AWG wire.

The ground wire is between about 8 and about 14 AWG wire and typically between about 10 and about 12 AWG wire. Power receptacle contacts suitably have about a 7.5 mm pitch. In an embodiment, the mating portion of the ground plug contact is longer than the mating portion of the hot and neutral plug contacts. The longer ground plug contact, which can be as long as about twice as long for example, provides two levels of mating for input power.

In still another aspect or embodiment, a modular connector system comprised of the above described power supply and ground return, has an electrical signal connector with between about 6 and about 40 mated signal contacts and typically between about 18 and about 32 mated signal contacts. Said modular connector system has a height between about 12 and about 25 mm off the board and typically between about 18 and about 22 mm off the board.

DETAILED DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
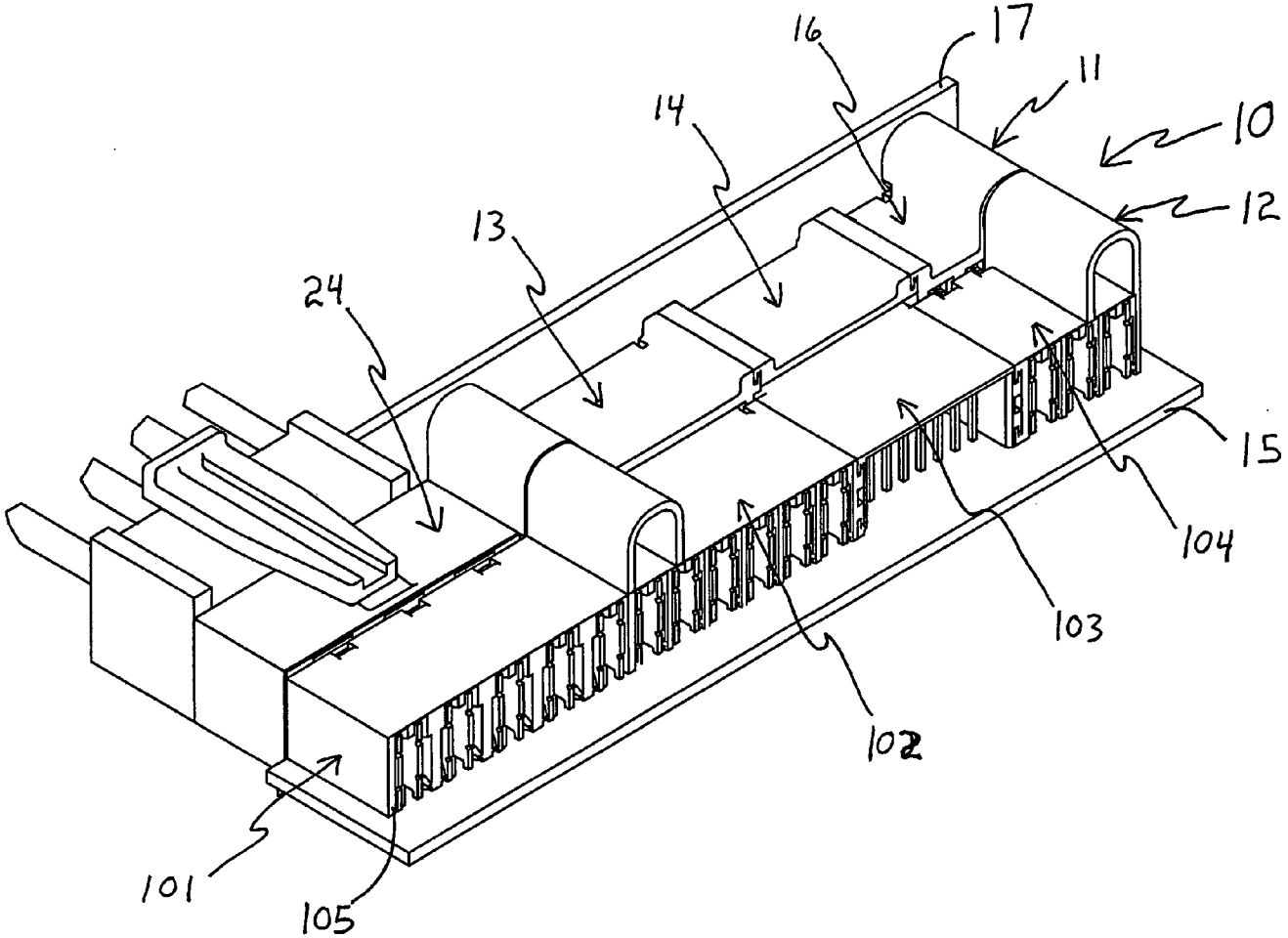
FIG. 1 is a perspective view of an embodiment of a modular receptacle connector assembly coupled to a modular plug connector assembly.

FIG. 1 represents an embodiment of a modular connector system, generally designated as 10. A particular embodiment of a modular connector system within which the present invention can be used is disclosed in detail in the description and drawings of a copending application of the present assignee, entitled "Low Profile Modular Electrical Connectors and Systems" and hereby incorporated by reference hereinto. Particular incorporation reference is made to plug and receptacle connector modules shown and described therein, including their mounting and engagement with each other and with other components.

The presently illustrated modular connector system 10 comprises a modular plug assembly having multiple plug connector modules and a modular receptacle assembly having multiple receptacle connector modules. Same is illustrated herein by a modular receptacle connector assembly, generally designated as 11, and a modular plug connector assembly, generally designated as 12. Modular plug assembly 12 is shown connecting PCB or mother board 15, considered horizontal as shown, to PCB or daughter board 17, considered to be vertical as shown. Modular connector system 10 is thus shown as one modular piece that connects two PCBs at a right angle. The system can be in a mid-plane or back-plane arrangement.

Figure 2:
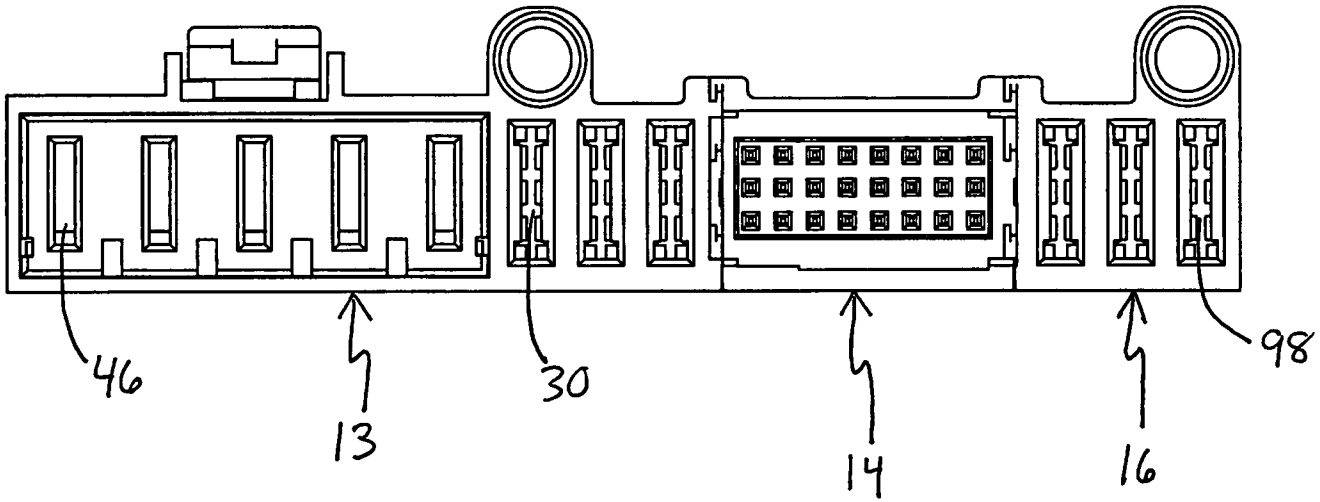
FIG. 2 is a front elevation view of a modular receptacle connector assembly as in FIG. 1.
Figure 2A:
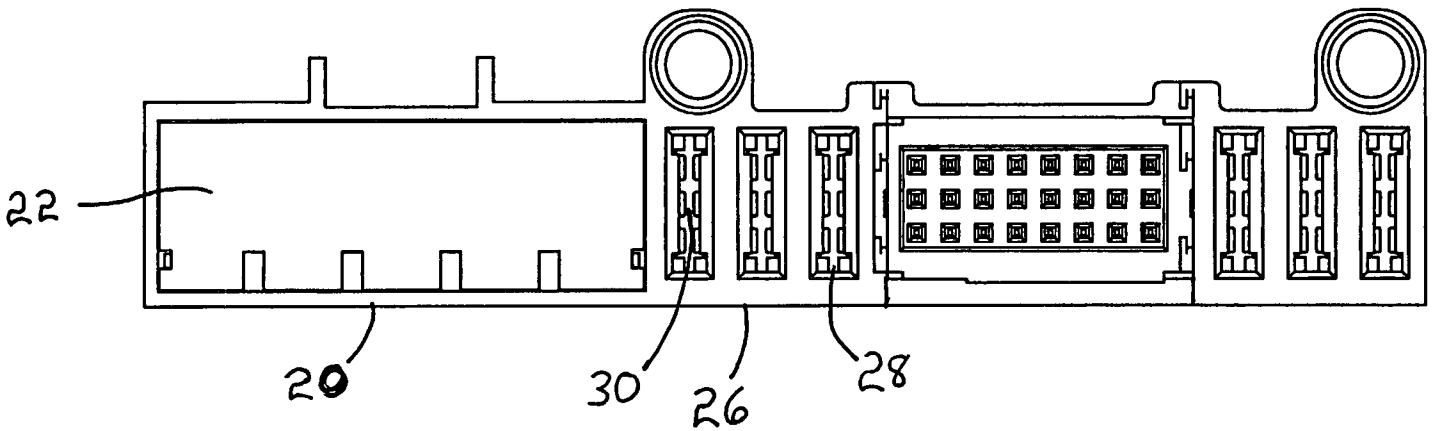
FIG. 2A is another front elevation view of a modular receptacle connector assembly as in FIG. 1, shown with a component removed.
Figure 3:
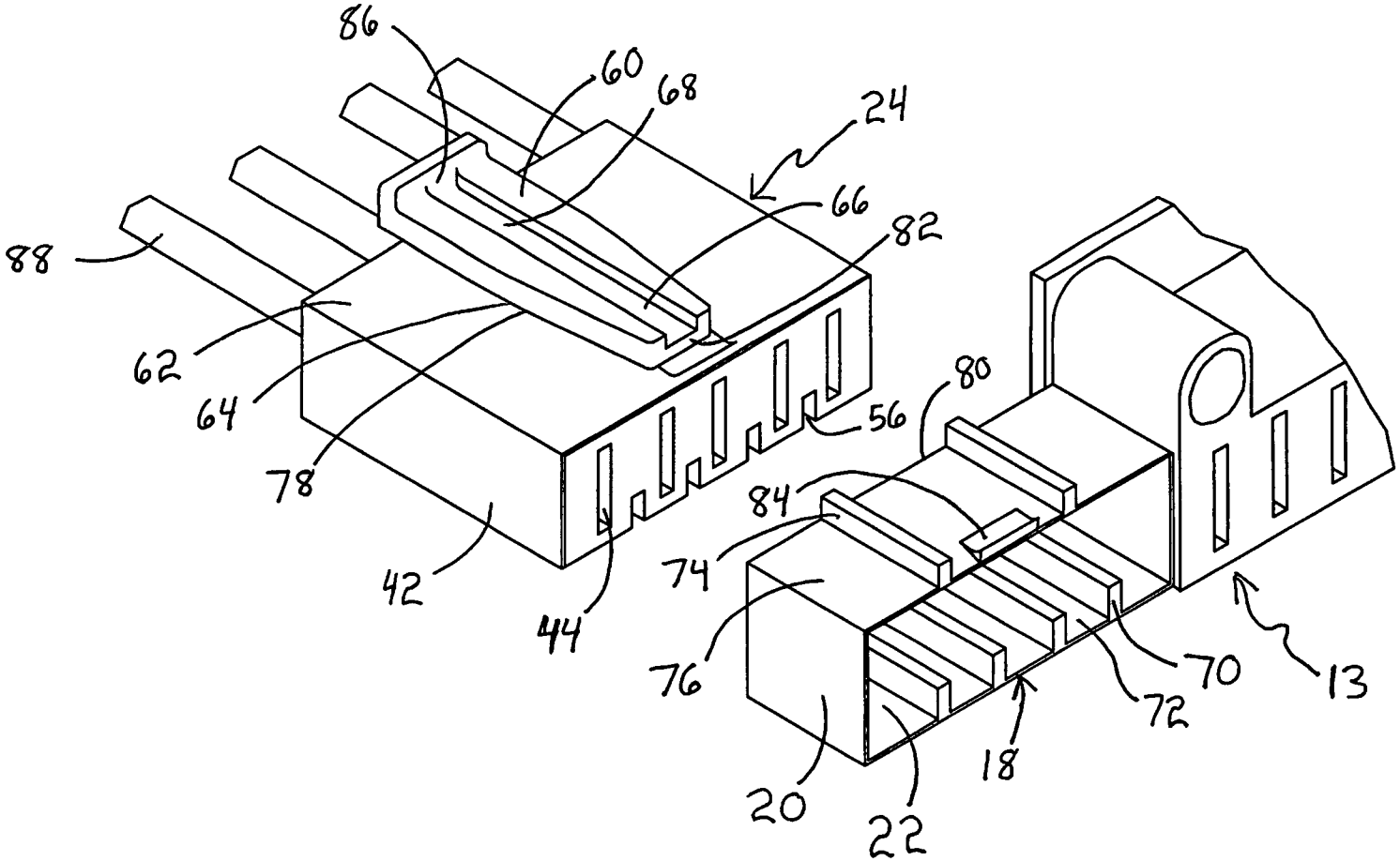
FIG. 3 is a detailed perspective view, partially broken away, of a power supply module.

In an embodiment, FIG. 2 illustrates receptacle power connector assembly 11 comprised of three interconnected modules which are receptacle modules in this embodiment, namely power receptacle module for AC and DC input power, generally designated as 13, receptacle module for electrical signal, generally designated as 14, and receptacle module for ground return, generally designated as 16. As seen in FIG. 2A, power receptacle module 13 functions as a pass-through module and has an insulative housing 18 that is comprised of two portions. Collar shaped portion 20 has elongated opening 22 that imparts pass-through functionality to the unit and is shown as arranged to receive separate power supply module that functions as an insertable module, generally designated as 24 shown in FIG. 3. Module 24 can be, for example, an AC power module. The other portion of the power receptacle module 13, is a power receptacle portion 26 (FIG. 2A) that has a plurality of cavities 28 in housing 18 to seat receptacle power contacts 30 (FIG. 2A).

Figure 3A:
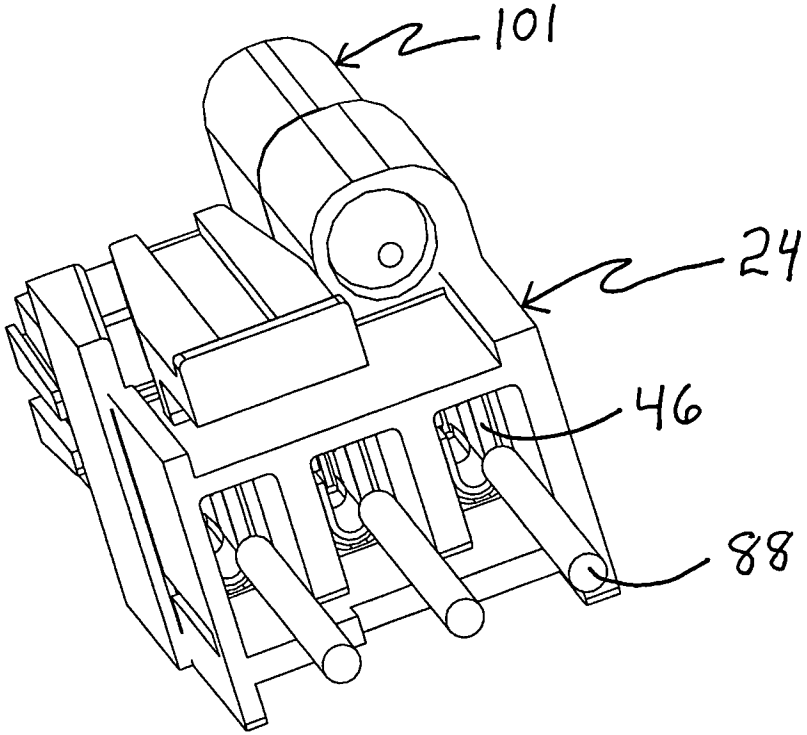
FIG. 3A is a perspective view of another embodiment of a power supply module coupled to a plug module.

Insertable power supply module 24 (FIG. 3) has an insulative housing 42 that has a plurality of cavities 44 that seat receptacle power contacts 46 (FIG. 3A). Power module 24 also has a plurality of guide slots 56 on surface 58 (considered a bottom surface) and a release latch, generally designated as 60 on surface 62 (considered a top surface). Release latch 60 is attached to surface 62 by means of fulcrum protrusion 64. Extending from fulcrum protrusion 64 is locking cantilevered beam 66 and releasing cantilevered beam 68. When the insertable power module 24 is inserted into elongated opening 22, guide slots 56 align with guide rails 70 placed on the inside surface 72 (considered a bottom surface) of the collar shaped portion 20. Locking cantilevered beam 66 also aligns between alignment rails 74 placed on surface 76 (considered a top surface) of the collar shaped portion 20. Insertion is completed when surface 78 (considered a front surface of fulcrum protrusion 64) contacts surface 80 (considered a top rear surface of power receptacle housing 18), thus providing an easy-connect capability to the power connector unit.

In this illustrated embodiment, a ramp protrusion 82 positioned at the tip of locking cantilevered beam 66 snaps into an indentation 84 on surface 76 that locks power supply module 24 into power receptacle module 13. This results in an easy-connect function having additional security and can beneficially provide a signal to the user that the connection has been successfully completed. Imparting digital pressure onto a surface 86 of releasing cantilevered beam 68 unlocks release latch 60 and allows power supply 24 to be removed from power receptacle module 13 for an easy-disconnect function.

In the above embodiment the power source may be plugged and unplugged from modular connector system 10 without unplugging the entire connector system. Furthermore, power supply module 24 connects directly to modular connector system 10 without the need for a separate power mount. It will be appreciated that this function can be accomplished with modifications to the illustrated embodiment. For example, the locking cantilevered beam 66 could have multiple protrusions and/or one or more indentations, with the surface 76 having one or more indentations and/or protrusions, respectively, that mate with and correspond to protrusions and/or indentations of the beam 66.

Power wires 88 as shown in FIG. 3A, connect with contacts 46 in power supply module 24. In this particular illustrative embodiment, one of the power wires 88 is a hot wire, one is a neutral wire, and one is a ground wire. Suitably, the hot wire and the neutral wire are between about 8 and about 14 AWG wire and typically between about 10 and about 12 AWG wire, and the ground wire is between about 8 and about 14 AWG wire and typically between 10 and about 12 AWG wire. Power receptacle contacts 46 suitably have about a 7.5 mm pitch and provide power supplies to the modular connector system 10. AC voltages can be between about 90 and about 600 volts and typically, between about 100 and about 250 volts. Each AC power supply can have a current of between about 10 and about 50 amps and typically between about 20 and about 40 amps. Each DC power supply can be between about 1 and about 70 volts and typically about between about 5 and about 18 volts.

In the depicted arrangement, power supply module 24 can be AC and power input portion 26 of power receptacle module 13, which can be DC, illustrates that modular connector system 10 can connect in both a board-to-board set-up and wire-to-board set-up. Receptacle contacts 46, power input receptacle contacts 30, and ground return receptacle contacts 98 align substantially in a row as shown in FIG. 2 in this illustrated embodiment.

Plug connector assembly 12 that is shown has four interconnected plug modules. FIG. 1 illustrates an AC transfer module, generally designated as 101, for receiving the separate power supply module 24, indicated as AC in this illustration. In this illustrated embodiment, the AC transfer module is a plug module. Also shown in this illustrated combination of modules are a DC power input plug module, generally designated as 102, electrical signal plug module, generally designated as 103, and ground return plug module, generally designated as 104. Plug connector modules 101, 102, 103 and 104 correspond to and mate with receptacle connector modules 24, 13, 14 and 16, respectively in this illustrated embodiment.

Figure 4:
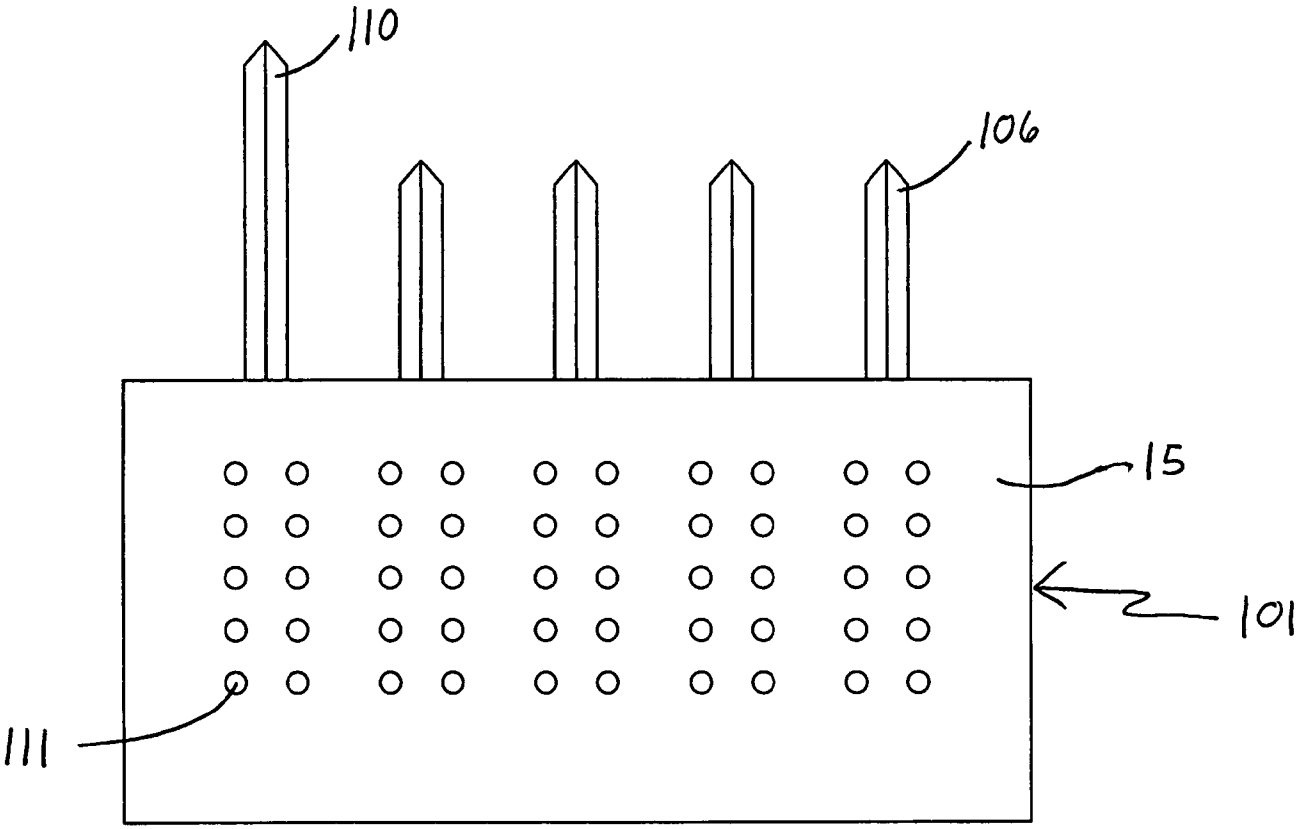
FIG. 4 is a bottom plan view of a plug module.

The illustrated embodiment of FIGS. 1 and 4 have an AC plug module 101 that functions as the AC module that transfers AC power and that connects with the insertable module 24 that enters the pass-through module collar 20. This has insulative housing 105 with AC plug contacts 106 and 110. Pins or tails 111 are provided for insertion into holes in board 15. The mating portion of ground plug contact 110 is longer than the mating portion of the hot and neutral plug contacts 106. The longer ground plug contact provides two levels of mating for power. With this approach, there is a beneficial staggering of the load during insertion or disengagement, such as when the longer contact goes in "hot". The extra length can be, for example, about equal to the exposed length of the other contacts 106, although shorter lengths such as shown in FIG. 4 can be suitable. For example, the extra length can be 4 mm when the exposed length of the contact 106 is 8 mm.

In another aspect or embodiment, the modular connector system 10 can provide the insertable connector module in the form of a plug connector, with the transfer module being a receptacle connector rather than a plug connector as it is shown in FIG. 4. The particular embodiment that is shown in FIG. 1 has a height between about 12 and about 25 mm off the board and typically between about 18 and about 22 mm off the board.

In another embodiment, FIGS. 5 through 9 illustrate modular connector system 210 comprising a modular plug assembly having multiple plug connector modules and a modular receptacle assembly having multiple receptacle connector modules. This embodiment is illustrated in these drawings in a so-called coplanar arrangement that includes a modular receptacle connector assembly, generally designated as 211, together with a modular plug connector assembly, generally designated as 212. Modular plug assembly 212 is shown connecting PCB or mother board 215, considered horizontal as shown, to PCB or daughter board 217, considered to be horizontal as shown. Modular connector system 210 is thus shown as one modular piece that connects two PCBs in a coplanar orientation. The system can be in a mid-plane or back-plane arrangement. As noted in other embodiments, the plug and receptor assemblies can be exchanged between those as shown.

Figure 5:
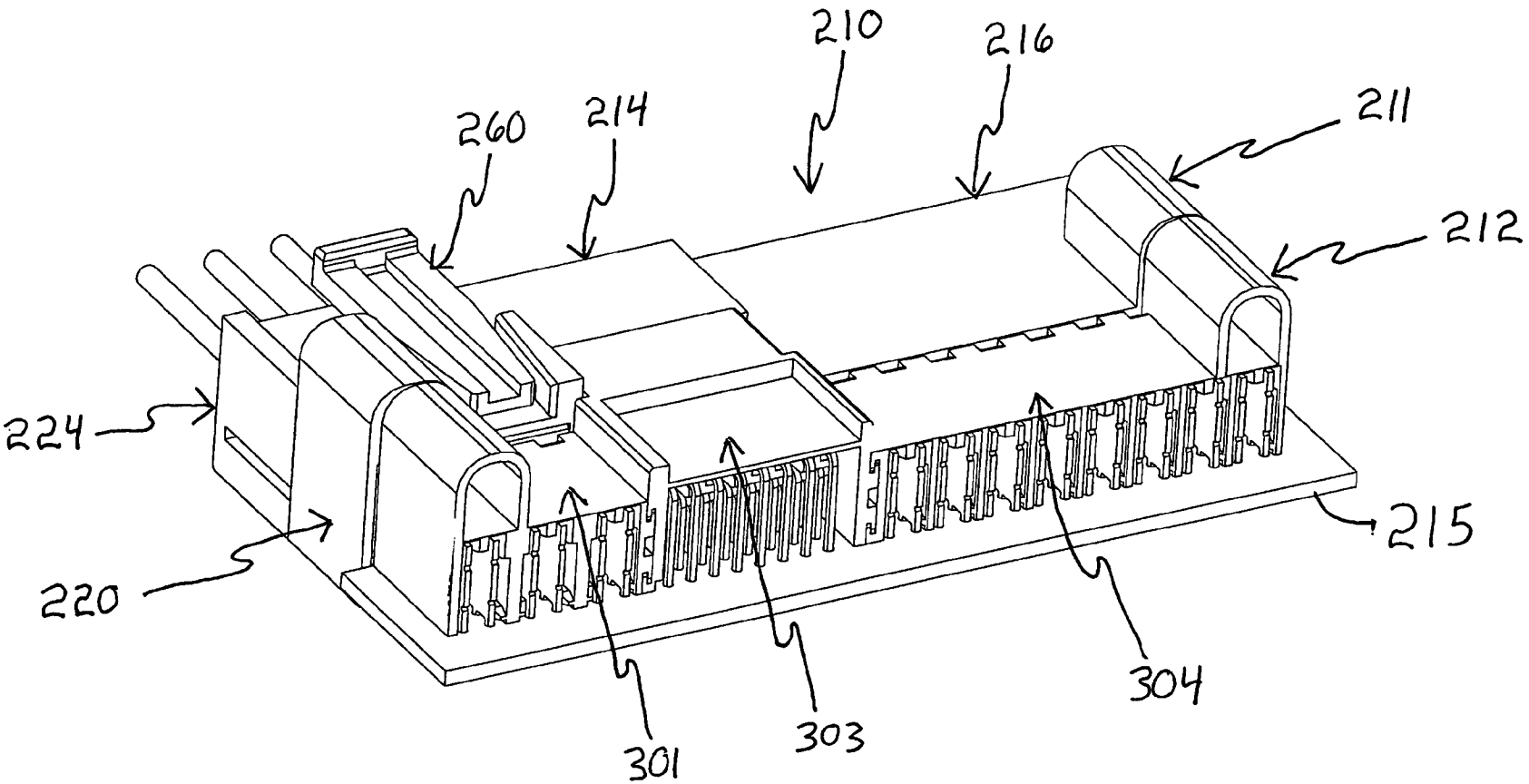
FIG. 5 is a perspective view of another embodiment of a modular receptacle connector assembly coupled to a modular plug connector assembly.
Figure 6:
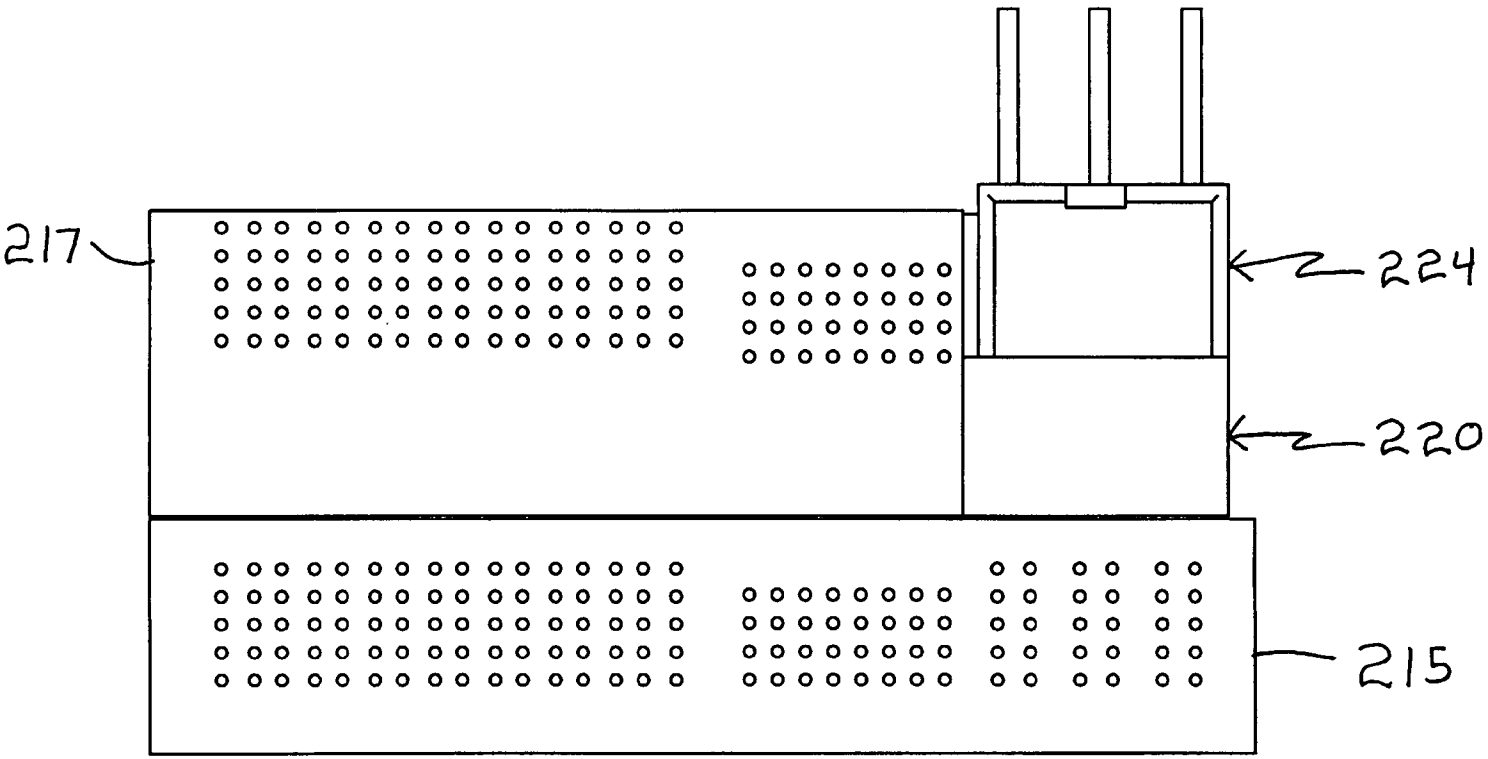
FIG. 6 is a bottom plan view of the modular receptacle connector assembly of FIG. 5.
Figure 7:
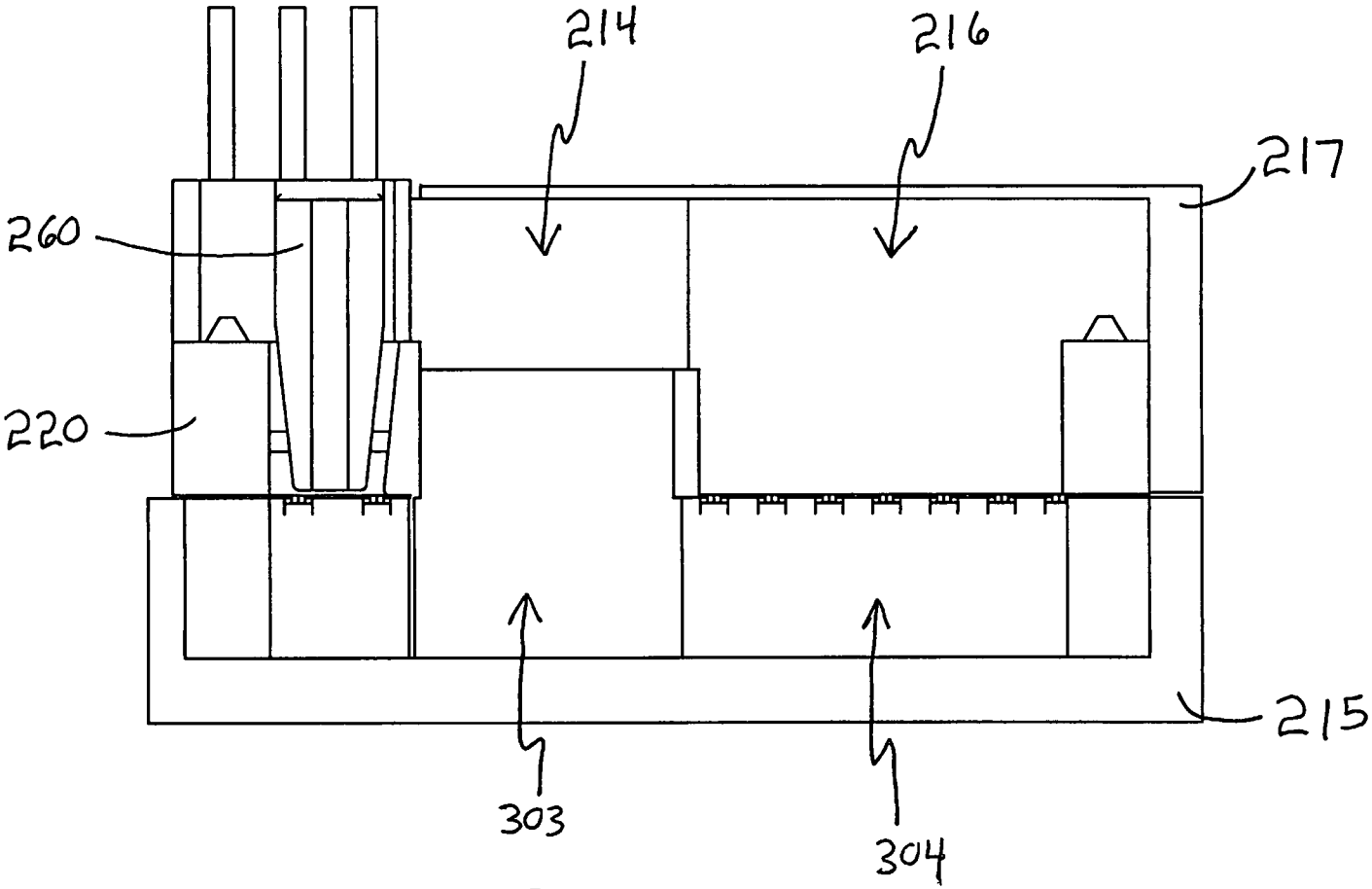
FIG. 7 is a top plan view of the modular receptacle connector assembly of FIG. 5.
Figure 8:
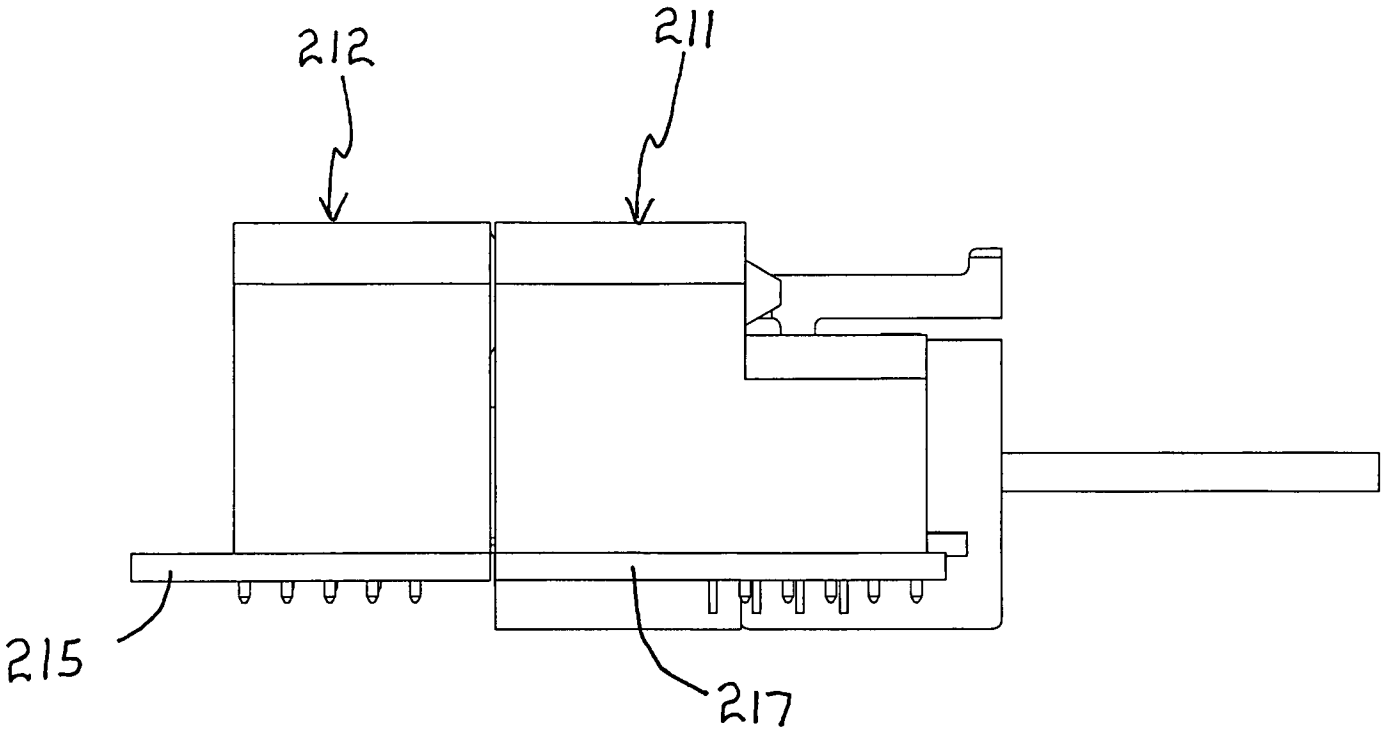
FIG. 8 is a side elevation view of the modular receptacle connector assembly of FIG. 5.
Figure 9:
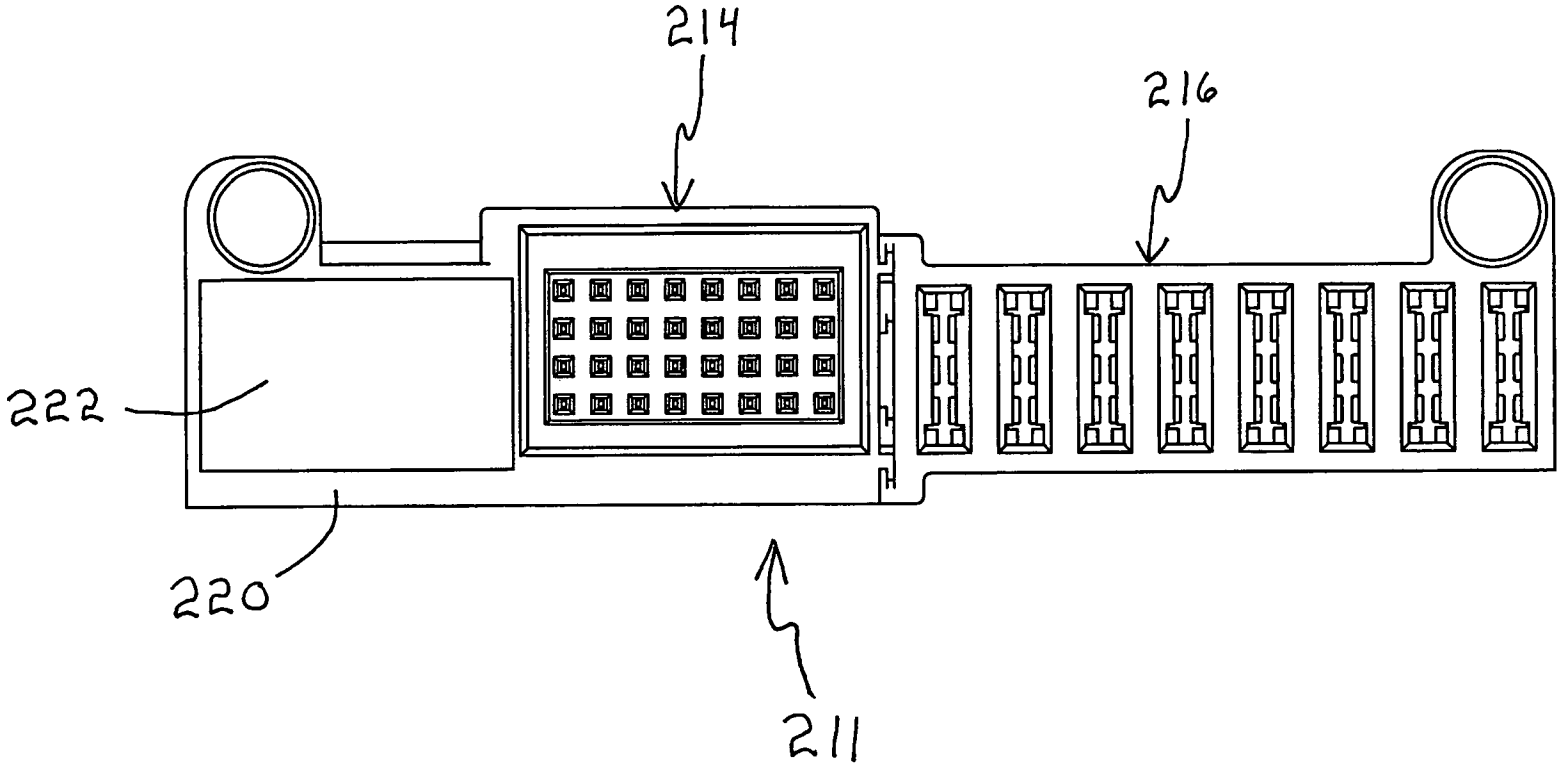
FIG. 9 is a front elevation view of a modular receptacle connector assembly as in FIG. 5, shown with a component removed.

FIG. 5 illustrates receptacle power connector assembly 211 comprised of three interconnected modules which are receptacle modules in this embodiment, namely power receptacle module for AC or DC input power, generally designated as 224, a receptacle module for electrical signal, generally designated as 214, and a receptacle module for ground return, generally designated as 216. Collar-shaped portion 220 has an elongated opening 222 (FIG. 9) that imparts pass-through functionality to the unit and is shown as arranged to receive separate power supply module that functions as an insertable module, generally designated as 224 shown in FIG. 5.

A release latch, generally designated as 260, is provided on the top surface (as illustrated) of the power module 224. The release latch 260 releasably engages the collar-shaped portion 220 by a snap-in and snap-out arrangement such that the insertable power module can be engaged and disengaged from the collar-shaped portion 220. When engaged, the insertable power module 224, whether receptacle or plug, is in position for connection to a complementary connector module, whether plug or receptacle. When disengaged, the incoming power module is easily detached from the rest of the modules and assembly without requiring other disassembly of the modules that are assembled together.

Plug connector assembly 212 that is shown in this embodiment has three interconnected plug modules. FIG. 5 illustrates a transfer module, generally designated as 301, for receiving the separate power supply module 224. In this illustrated embodiment, the transfer module is a plug module. Also shown are an electrical signal plug module generally designated as 303 and ground return plug module generally designated as 304. Plug connector modules 301, 303 and 304 correspond to and mate with receptacle connector modules 224, 214 and 216, respectively, in this illustrated embodiment.

It will be understood that there are numerous modifications of the illustrated embodiments described above which will be readily apparent to one skilled in the art, such as many variations and modifications of the power connector and/or its components including combinations of features disclosed herein that are individually disclosed or claimed herein, explicitly including additional combinations of such features, or alternatively other types of power connectors. Also, there are many possible variations in the materials and configurations. These modifications and/or combinations fall within the art to which this invention relates and are intended to be within the scope of the claims, which follow.

The invention claimed is:

1. A modular connector system that comprises:

a first modular connector configured to be mounted on a circuit board and, in operation, to engage with another connector in a direction parallel to the circuit board;

a second modular connector integral with the first modular connector and having a first side and a second side opposing the first side, the second modular connector having a pass-through opening extending from the first side to the second side, wherein the pass-through opening is configured to allow insertion from the first side to the second side in a direction parallel to the circuit board; and a removably insertable modular connector that is configured to be connected to power wiring and is inserted in the pass-through opening.

2. The modular connector system of claim 1, wherein the second modular connector is configured to extend, in operation, over an edge of the circuit board on which the first modular connector is mounted.

3. The modular connector system of claim 1, wherein the insertable modular connector is selected from the group of a plug connector and a receptacle connector.

4. The modular connector system of claim 1, further comprising a circuit board supporting the first modular connector, wherein the pass-through opening of the second modular connector provides is orientated so as to allow insertion in a direction that is parallel with a surface formed by the circuit board.

5. A modular connector system that comprises:

a circuit board with a surface;

a first modular connector supported by the circuit board and configured, in operation, to engage with another connector in a direction parallel to the circuit board;

a second modular connector integral with the first modular connector and having a first side and a second side, the second modular connector having a pass-through opening extending from the first side to the second side, wherein the pass-through opening is configured to allow insertion from the first side to the second side in a direction parallel to the circuit board; and a removably insertable modular connector that is configured to be connected to power wiring and is inserted in the pass-through opening, wherein the pass-through opening of the second modular connector provides is orientated so as to allow insertion in a direction that is parallel with the surface, wherein the second modular connector extends in a cantilevered manner past an edge of the circuit board.

6. The modular connector system of claim 1, further comprising a releasable latch for releasably locking together the insertable module and the second modular connector.

7. The modular connector system of claim 6, wherein the modular connector system includes a mounting side and an opposing top side and the releasable latch is mounted on the top side.

8. The modular connector system of claim 7, wherein said releasable latch is supported by the insertable module, and the second modular connector includes a locking member, and the releasable latch and locking member are configured to selectively engage and disengage each other.

9. The modular connector system of claim 8, wherein the-releasable latch comprises a locking cantilevered beam, a releasing cantilevered beam and a fulcrum protrusion attaching the releasable latch to the insertable modular connector.

* * * * *